US006321472B1

(12) United States Patent
Perko et al.

(10) Patent No.: US 6,321,472 B1
(45) Date of Patent: Nov. 27, 2001

(54) IRON WITH IMPROVED HEEL REST AND SLIDING FILL DOOR

(75) Inventors: Stacie L. Perko, Pembroke Pines, FL (US); Bruce R. Roberts, Hattiesburg, MS (US); Mark C. Matthews, Somerville; Ronald J. Vish, West Roxbury, both of MA (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 09/388,676

(22) Filed: Sep. 2, 1999

(51) Int. Cl.[7] ..... D06F 75/38; D06F 75/40
(52) U.S. Cl. ..... 38/88; 38/96
(58) Field of Search ..... 38/88, 91, 92, 38/77–79, 96

(56) References Cited

U.S. PATENT DOCUMENTS 2,485,955 * 10/1949 Busch ..... 38/88 X
4,115,935 * 9/1978 Toft ..... 38/88
5,010,664 * 4/1991 Sakano et al. ..... 38/77.5
5,390,433 * 2/1995 Brady ..... 38/88
5,619,812 * 4/1997 Hensel et al. ..... 38/88
5,799,421 * 9/1998 Bouleau ..... 38/88

FOREIGN PATENT DOCUMENTS

75097 * 4/1984 (JP) ..... 38/77.5
166199 * 9/1984 (JP) ..... 38/77.1
1141692 * 6/1989 (JP) ..... 38/77.8

* cited by examiner

*Primary Examiner*—Ismael Izaguirre
(74) *Attorney, Agent, or Firm*—Krame Levin Naftalis & Frankel LLP

(57) ABSTRACT

An iron includes a soleplate and a water tank connected to the soleplate for supplying steam to the soleplate. The water tank includes a cavity for holding water, a fill opening for filling the cavity with water, and a guide arrangement associated with the fill opening. A handle is connected with the water tank. A rear cover is connected to a rear end of the water tank, the rear cover having a rear plate in covering relation to a rear portion of the iron, and the rear plate including an arrangement for stabilizing the iron in an upright position on a soft surface. The arrangement includes a recess in an outer surface of the rear plate, and at least one non-slip foot extending from the outer surface of the rear plate. A fill door is slidably mounted on the guide arrangement between a closed position in covering relation to the fill opening and an open position to permit filling of the cavity with water through the fill opening.

26 Claims, 16 Drawing Sheets

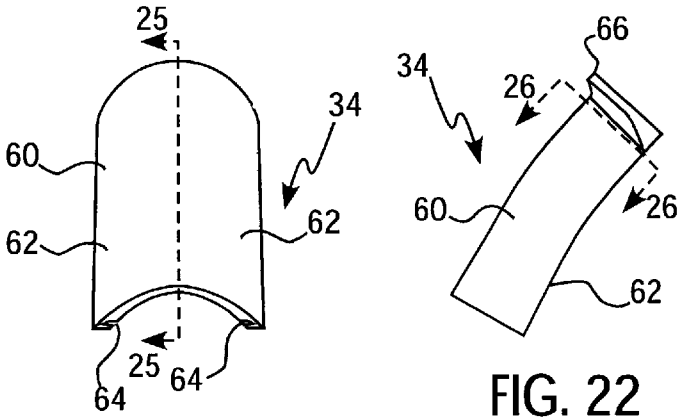
FIG. 21
FIG. 22
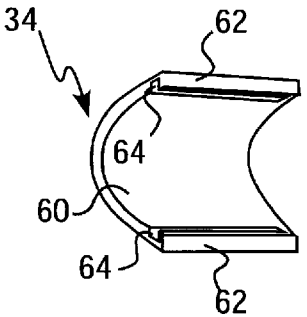
FIG. 24
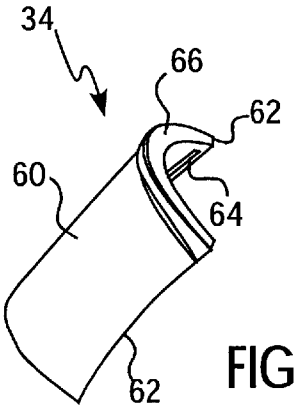
FIG. 23
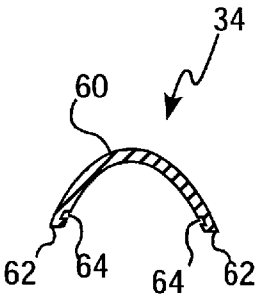
FIG. 25
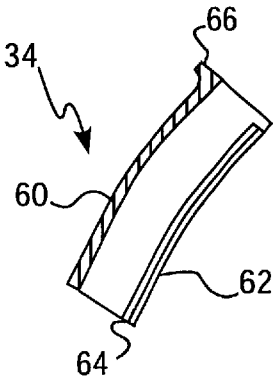
FIG. 26

IRON WITH IMPROVED HEEL REST AND SLIDING FILL DOOR

FIELD OF THE INVENTION

The present invention relates generally to an iron, and more particularly, to an improved heel rest and an improved sliding fill door for an iron.

BACKGROUND INFORMATION

Generally, the ironing of clothing occurs on an ironing board having a flat surface made from metal or wood. An ironing board cover is generally placed over the flat surface. However, when the soleplate of the iron contacts the surface of the ironing board, high temperatures result, which may cause the fabric being ironed to burn. As a result, padding is generally placed between the ironing board and the ironing board cover to function as insulation between the ironing board and iron. The padding may even be incorporated directly into the manufacture of the ironing board cover. The padding also serves an additional purpose of providing a smoother and softer surface to enable the iron to more freely and smoothly traverse the surface of the fabric.

Generally, when a person is adjusting the article to be ironed, the iron is left supported by the heel of the iron in an upright position. When the person is finished ironing, the iron is placed in an upright position on the ironing board. One reason for placing the iron in an upright position is because of the high temperatures that the soleplate of the iron attain, for example, temperatures greater than the boiling temperature of water. As a result, if the iron tips over onto the fabric being ironed, or tips over onto furniture or a carpet, burning or discoloring may result. In addition, a steam iron left in its vertical position may tip and leak water from the pores of the soleplate onto an item, such as the fabric being ironed, furniture or carpet, thus possibly staining the item. Accordingly, it is desirable to have an iron which will remain stable in its upright position.

Known irons include rear covers or heel rests having a shape or a configuration not conducive to providing stability to an iron in the upright position when placed on soft surfaces.

Generally, heel rests for irons are flat, smooth and may contain a plurality of ridges. Such irons are disclosed in Van Surksum, U.S. Design Pat. Nos. 316,621 and 317,519; Gudefin, U.S. Design Pat. No. 326,939; Stutzer, et al., U.S. Design Pat. No. 349,377; and Simmon, U.S. Design Pat. No. 349,378. Irons having a heel rest are also disclosed in Japanese Patent No. 03-075100-A and German Patent No. 20 54 327.

Irons having a generally flat heel rest tend to tip over on a soft padded surface, thereby possibly burning the person ironing the clothes or causing a fire hazard to the household.

In this regard, Hensel et al, U.S. Pat. No. 5,619,812, having a common assignee herewith, attempts to overcome the disadvantages of the above heel rests. The iron of this patent includes a heel rest having a recess in the outer surface so that the iron will be less likely to tip over while in its upright position on a soft surface. In such case, as the weight of the iron forces the soft surface downwards, the portion of the soft surface directly underneath the recess moves upward to fill in the recess. As a result, the soft surface in the recess acts as a barrier in the recess to prevent the iron from tipping over. However, even with this heel rest, it is possible that some slippage may occur.

Further, many irons provide a fill opening at the top for filling the iron with water. In some irons, a door is placed over the fill opening to prevent water from spilling out during the ironing process. For example, McMullen, U.S. Pat. No. 4,233,763 and Kubicz et al., U.S. Pat. No. 5,799,420 each disclose a fill door that is pivotally connected in overlying relation to the fill opening. However, such pivotal fill doors can be easily broken by a user and are not very stable.

OBJECTS AND SUMMARY OF THE INVENTION

Accordingly, it is an object of the present invention to provide an iron that overcomes the aforementioned deficiencies of prior art irons.

It is another object of the present invention to provide an iron with an improved heel rest to prevent the iron from tipping over.

It is still another object of the present invention to provide an iron in which rubber feet are provided on the heel rest adjacent the recess.

It is yet another object of the present invention to provide an iron with a slidable fill door at an upper front portion thereof, in covering relating to the fill opening.

In accordance with an aspect of the present invention, an iron includes a soleplate, a water tank connected to the soleplate for supplying steam to the soleplate, the water tank including a cavity for holding water, and a handle connected with the water tank. A rear cover is connected to a rear end of the water tank, the rear cover having a rear plate in covering relation to a rear portion of the iron, and the rear plate including an arrangement for stabilizing the iron in an upright position on a soft surface. Specifically, the arrangement includes a recess in an outer surface of the rear plate, and at least one non-slip foot extending from the outer surface of the rear plate.

In accordance with another aspect of the present invention, an iron includes a soleplate, and a water tank connected to the soleplate for supplying steam to the soleplate. The water tank includes a cavity for holding water, a fill opening for filling the cavity with water, and a guide arrangement associated with the fill opening. A handle is connected with the water tank. A fill door is slidably mounted on the guide arrangement between a closed position in covering relation to the fill opening and an open position to permit filling of the cavity with water through the fill opening.

The guide arrangement includes parallel, spaced apart guide rails, and the fill door includes opposite lengthwise edges with grooves for riding along the guide rails. Preferably, the fill door has a part cylindrical shape. In addition, a housing is in surrounding relation to the water tank, with a gap therebetween, and the fill door slides within the housing in the open position. In this regard, the fill door includes a finger tab at an upper edge thereof for moving the fill door between the upper and lower positions, and for limiting sliding movement of the fill door within the housing.

In accordance with still another aspect of the present invention, an iron includes a soleplate and a water tank connected to the soleplate for supplying steam to the soleplate. The water tank includes a cavity for holding water, a fill opening for filling the cavity with water, and a guide arrangement associated with the fill opening. A handle is connected with the water tank. A rear cover is connected to a rear end of the water tank, the rear cover having a rear plate in covering relation to a rear portion of the iron, and the rear plate including an arrangement for stabilizing the iron in an upright position on a soft surface. The arrangement includes a recess in an outer surface of the rear plate, and at least one non-slip foot extending from the outer surface of the rear plate. A fill door is slidably mounted on the guide arrangement between a closed position in covering relation to the fill opening and an open position to permit filling of the cavity with water through the fill opening.

The above and other objects, features and advantages of the present invention will become readily apparent from the following detailed description thereof which is to be read in connection with the accompanying drawings.

BRIEF DESCRIPTION OF THE DRAWINGS

FIG. 21 is a top front perspective view of an exemplary fill door of the iron;

FIG. 22 is a side elevational view of the fill door;

FIG. 23 is a side perspective view of the fill door;

FIG. 24 is a bottom perspective view of the fill door;

FIG. 25 is a cross-sectional view of the fill door, taken along line 25—25 of FIG. 21; and FIG. 26 is a cross-sectional view of the fill door, taken along line 26—26 of FIG. 22.

DETAILED DESCRIPTION

Figure 1:
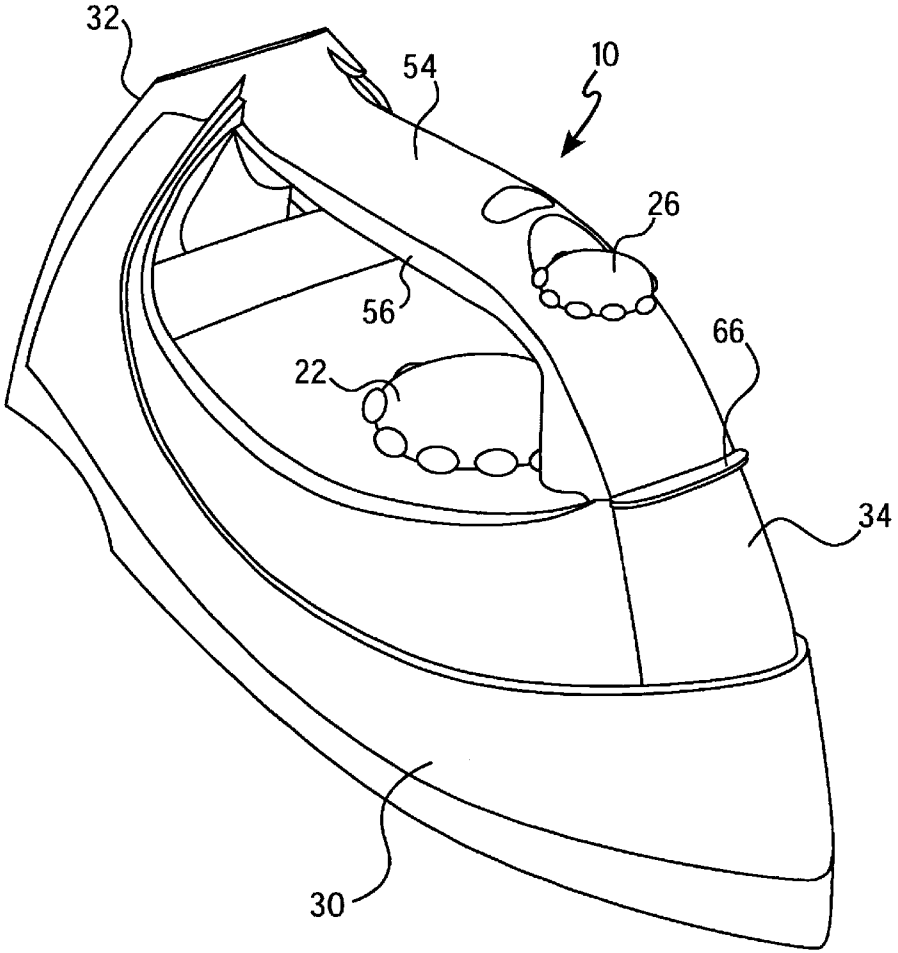
FIG. 1 is a front perspective view of an iron according to an exemplary embodiment of the present invention.
Figure 2:
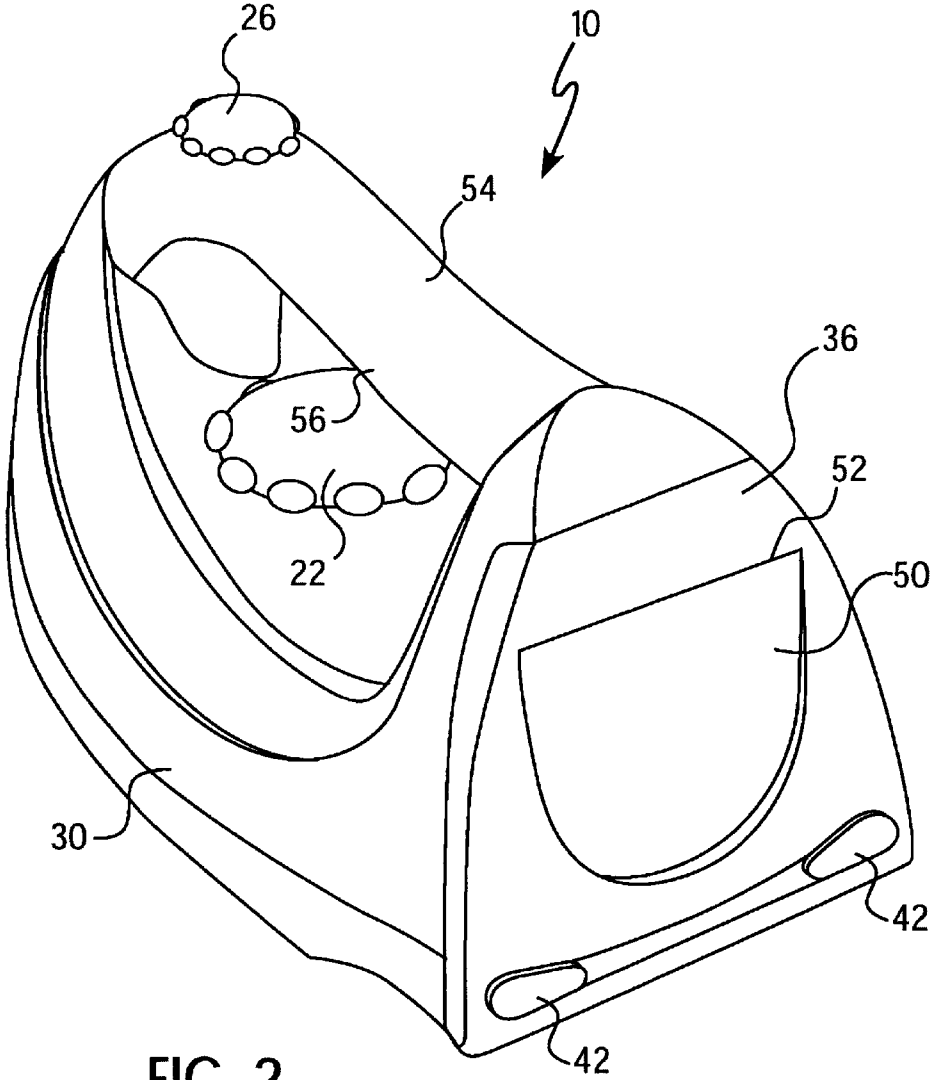
FIG. 2 is a rear perspective view of the iron.
Figure 3:
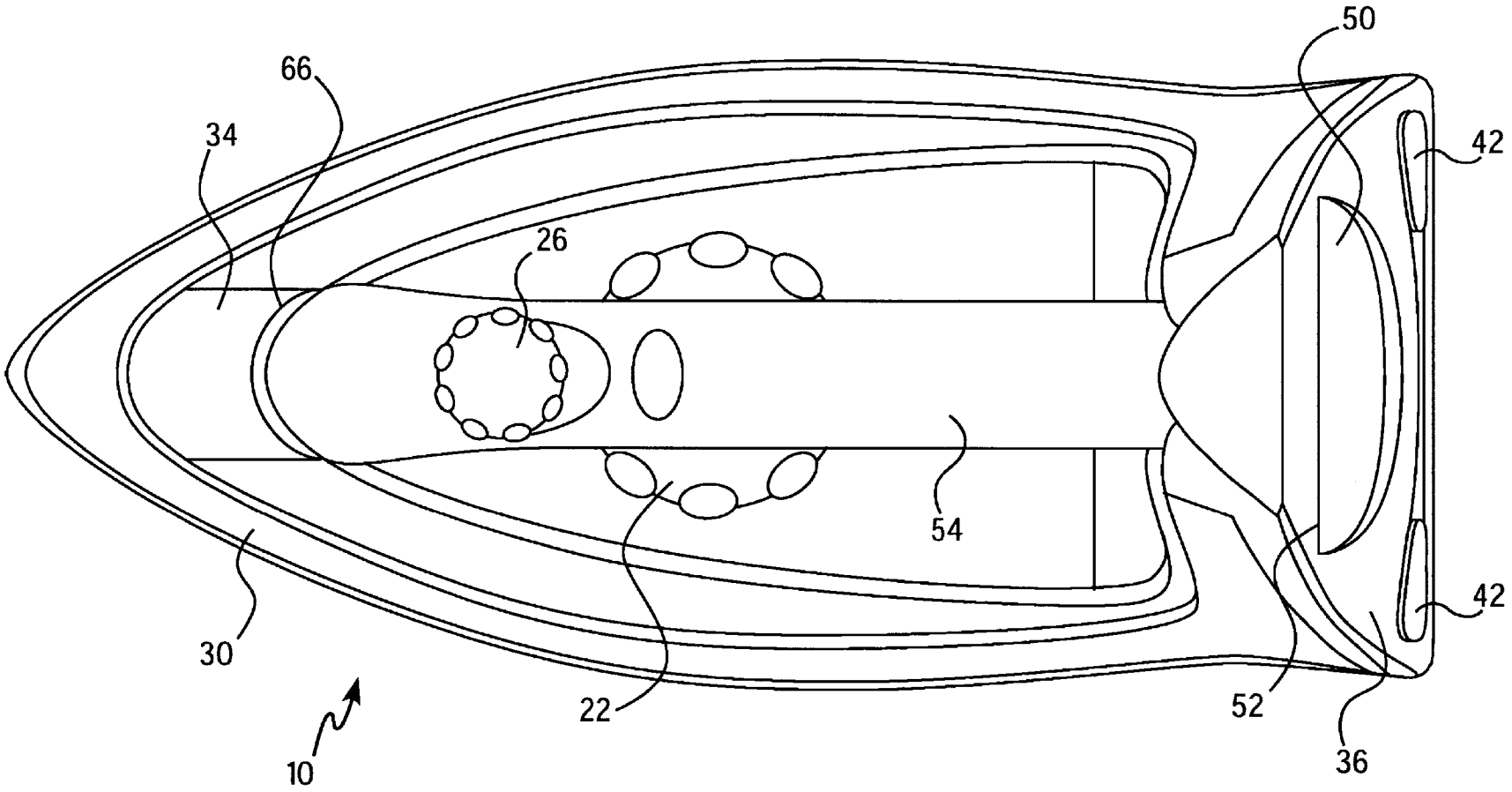
FIG. 3 is a top plan view of the iron.
Figure 4:
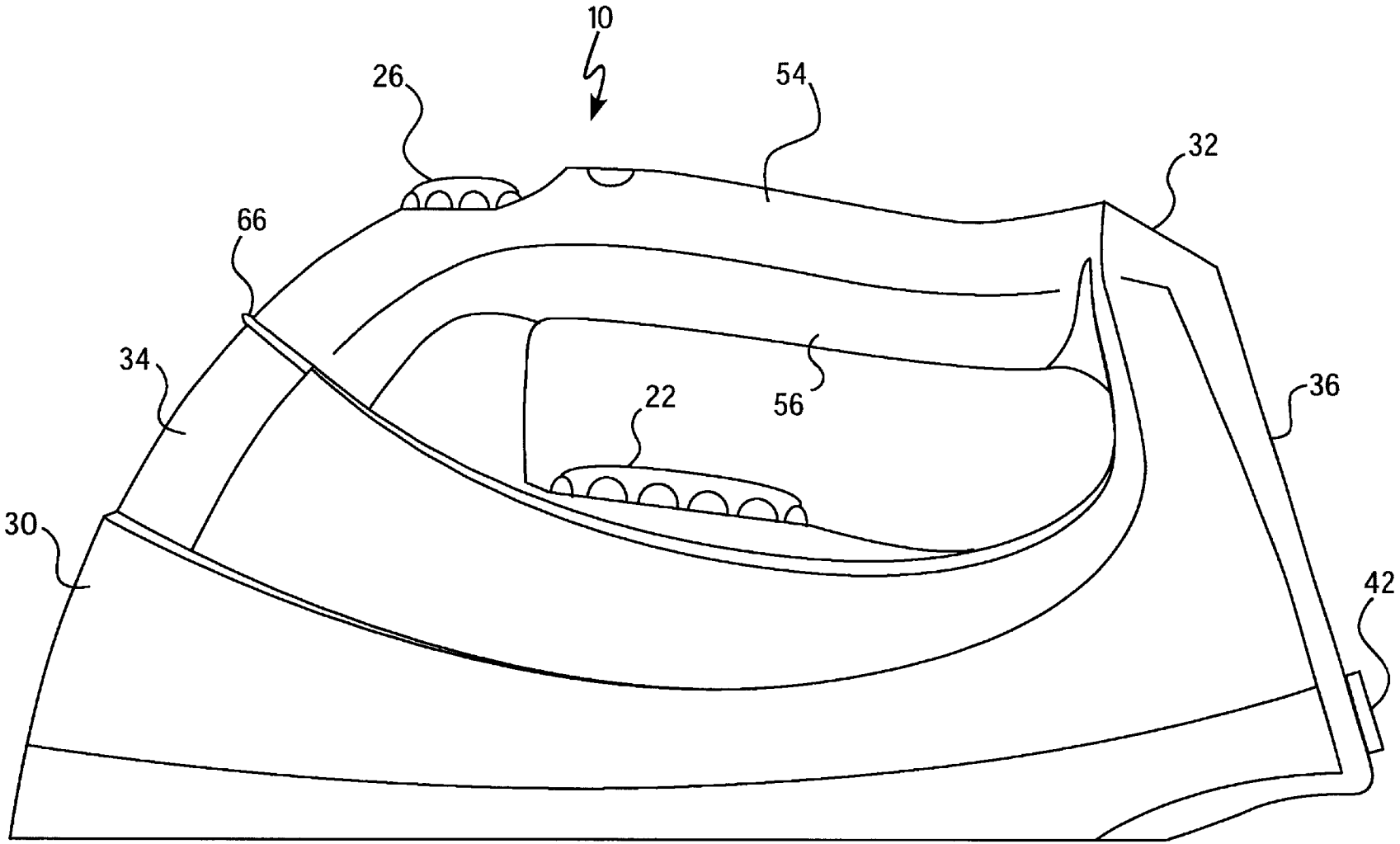
FIG. 4 is a side elevational view of the iron.
Figure 6:
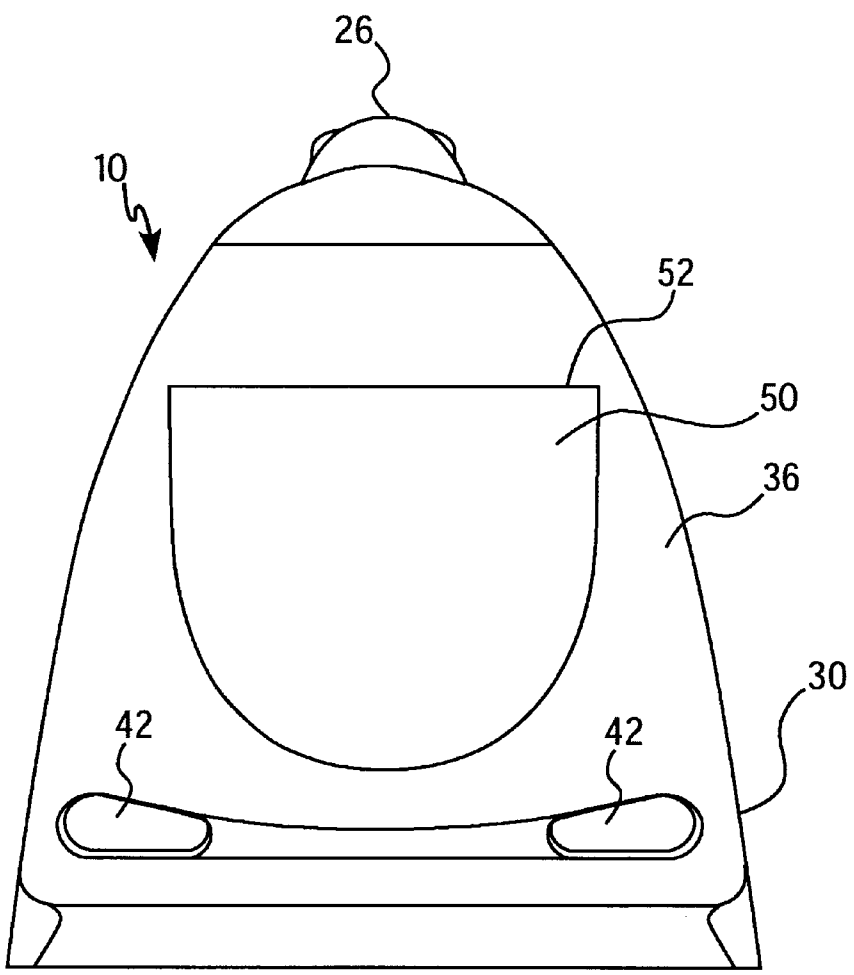
FIG. 6 is rear elevational view of the iron.
Figure 5:
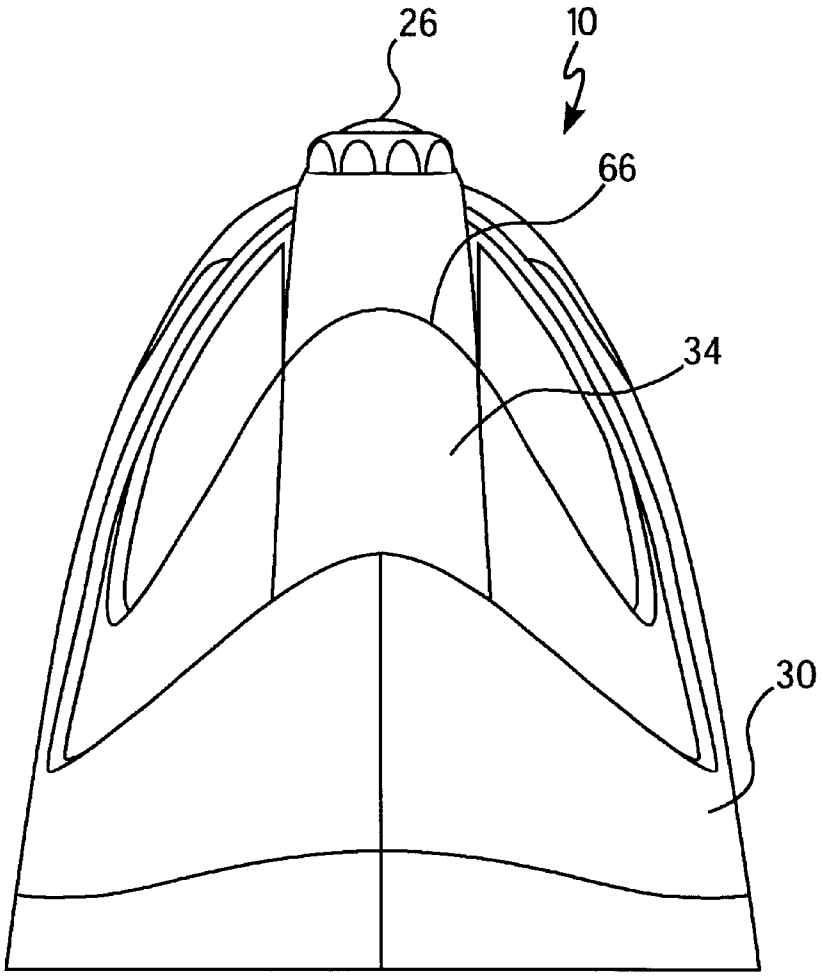
FIG. 5 is a front elevational view of the iron.
Figure 7:
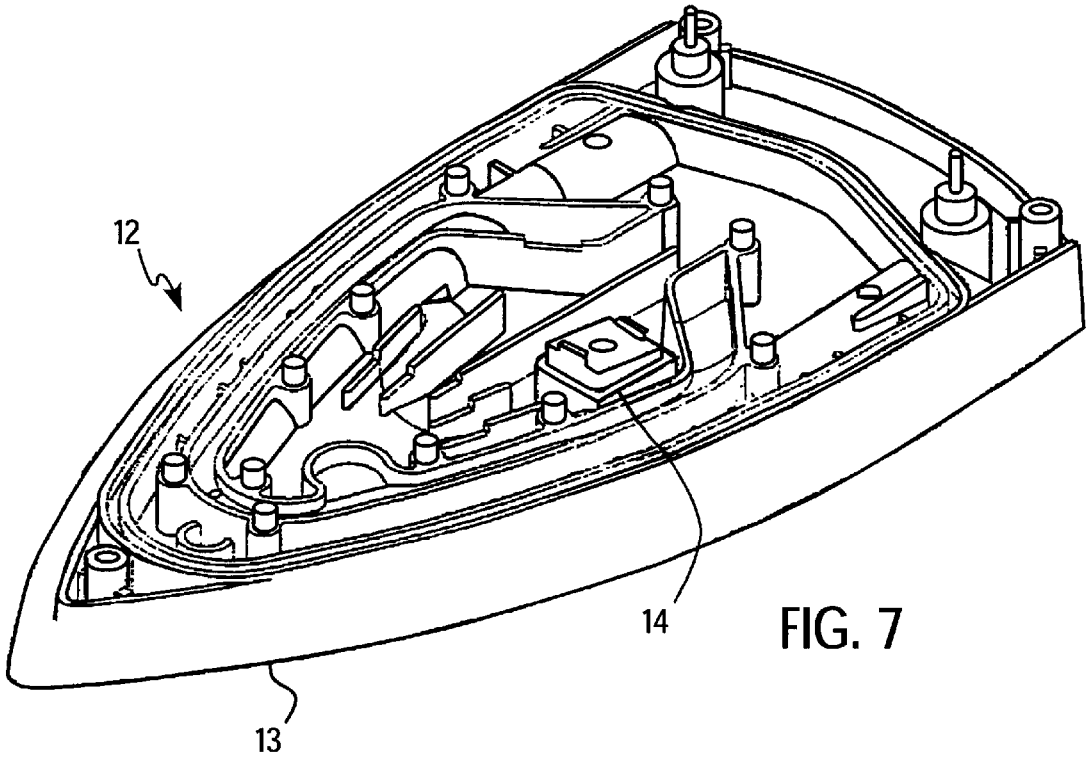
FIG. 7 is a perspective view of an exemplary soleplate of the iron.
Figure 8:
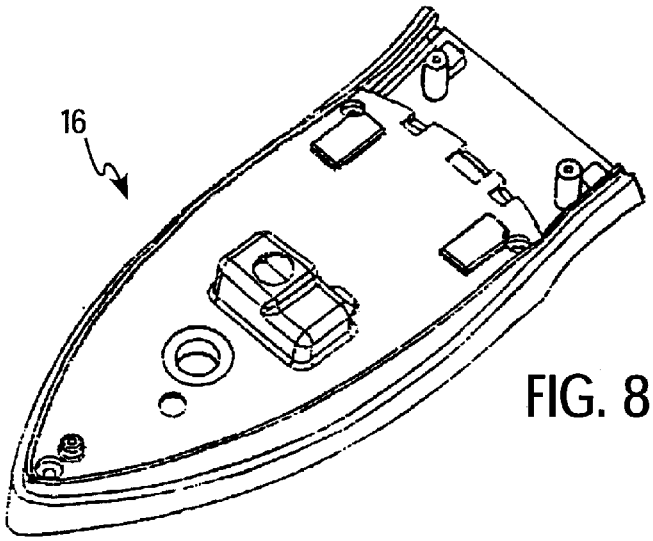
FIG. 8 is a perspective view of an exemplary skirt of the iron.
Figure 13:
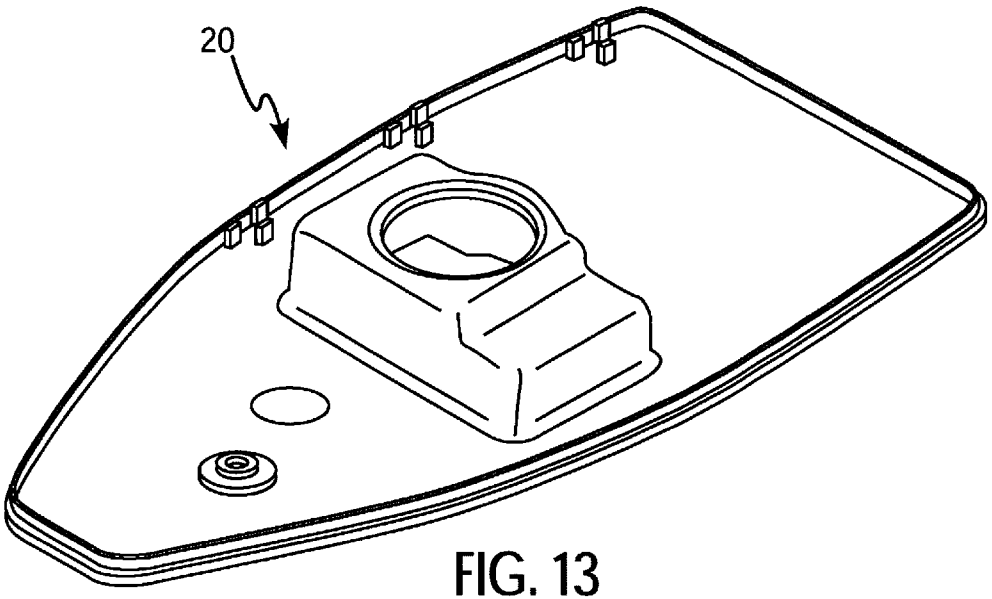
FIG. 13 is a perspective view of the water tank cover of the iron.

Referring to the drawings in detail, an iron 10 according to an exemplary embodiment of the present invention includes a soleplate 12 (FIG. 7) made of, for example, a metal material and having a heating element 14 mounted in good heat conducting relationship therewith. Soleplate 12 has, for example, a bottom face or pressing surface 13 adapted to be placed in contact with a suitable fabric to be ironed. A skirt 16 (FIG. 8) is mounted on soleplate 12, followed by a water tank 18 (FIGS. 9–12) mounted on top of skirt 16 and secured to skirt 16 and soleplate 12 by the use of, for example, screws, flanges, or any other conventional means for fastening. A water tank cover 20 (FIG. 13) is interposed between skirt 16 and water tank 18.

Figure 15:
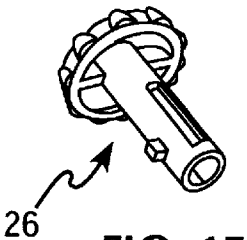
FIG. 15 is a perspective view of an exemplary steam dial of the iron.
Figure 14:
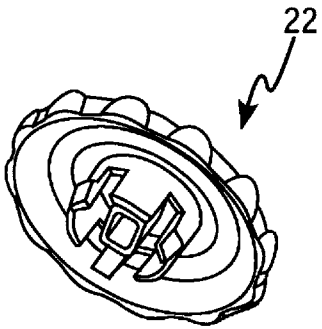
FIG. 14 is a perspective view of an exemplary temperature dial of the iron.

Water tank 18 includes a cavity 19 (FIG. 12) which may be filled with an aqueous solution such as water. A temperature dial 22 (FIG. 14) is fit, for example, within a lower opening 24 of water tank 18 and a steam dial 26 (FIG. 15) is fit, for example, on an upper cylindrical support 28 of water tank 18, both in open communication with the water in cavity 19. Water contained in tank 18 may be delivered to soleplate 12, for example in response to activation of controls disposed in handle 56, where it is emitted as steam from openings in soleplate 12 in a well-known manner.

Figure 16:
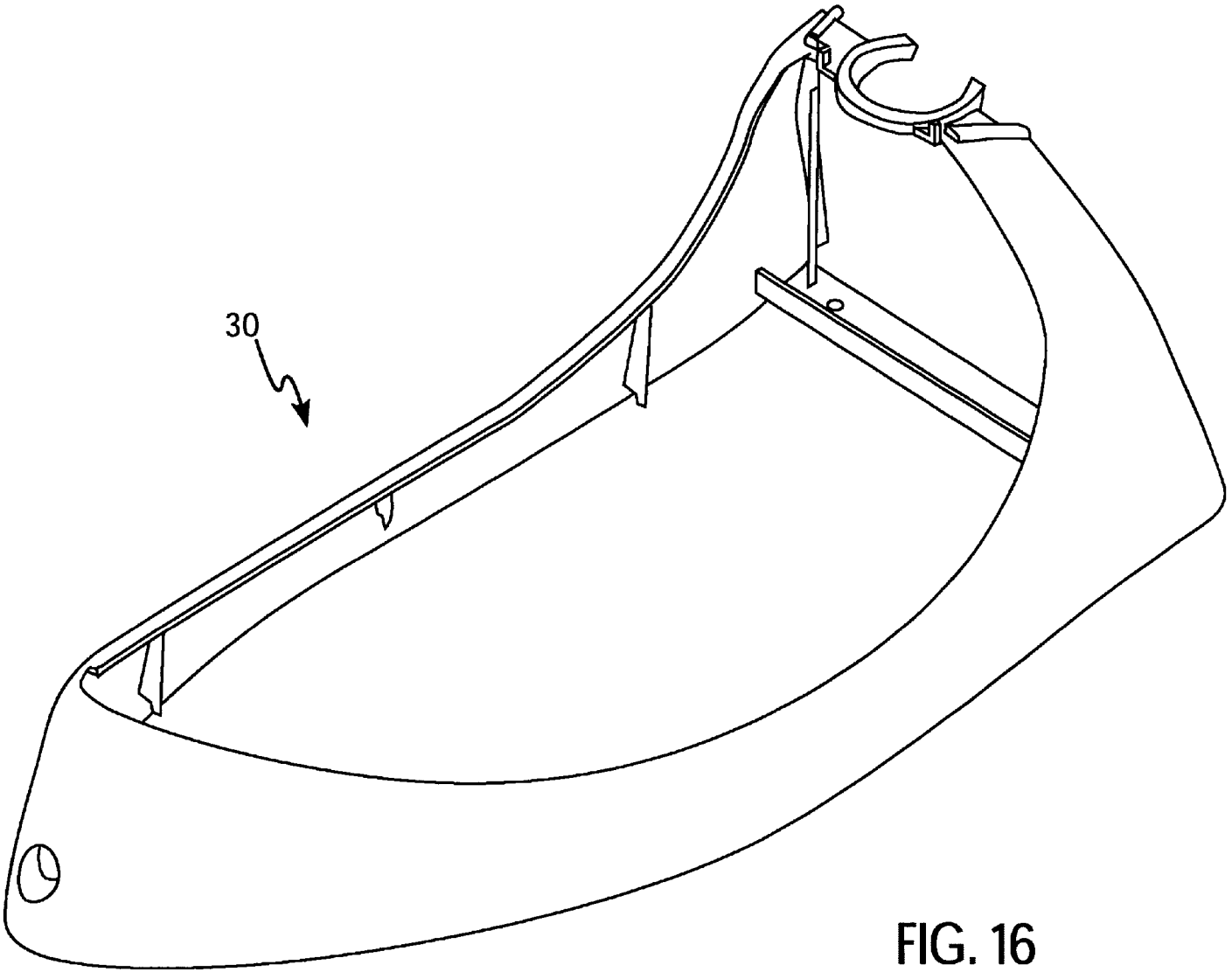
FIG. 16 is a perspective view of an exemplary housing of the iron.

A housing 30 (FIG. 16) is provided, for example, in surrounding relation to the aforementioned elements. Further, a heel rest or rear cover 32 (FIGS. 17–20) is secured to a rear end of water tank 18, and a portion of the top of the aforementioned assembly by a snap fit or other arrangement. Finally, a fill door 34 (FIGS. 21–26) is provided in covering relation to a fill opening 35 in water tank 18.

Figures 17, 20:
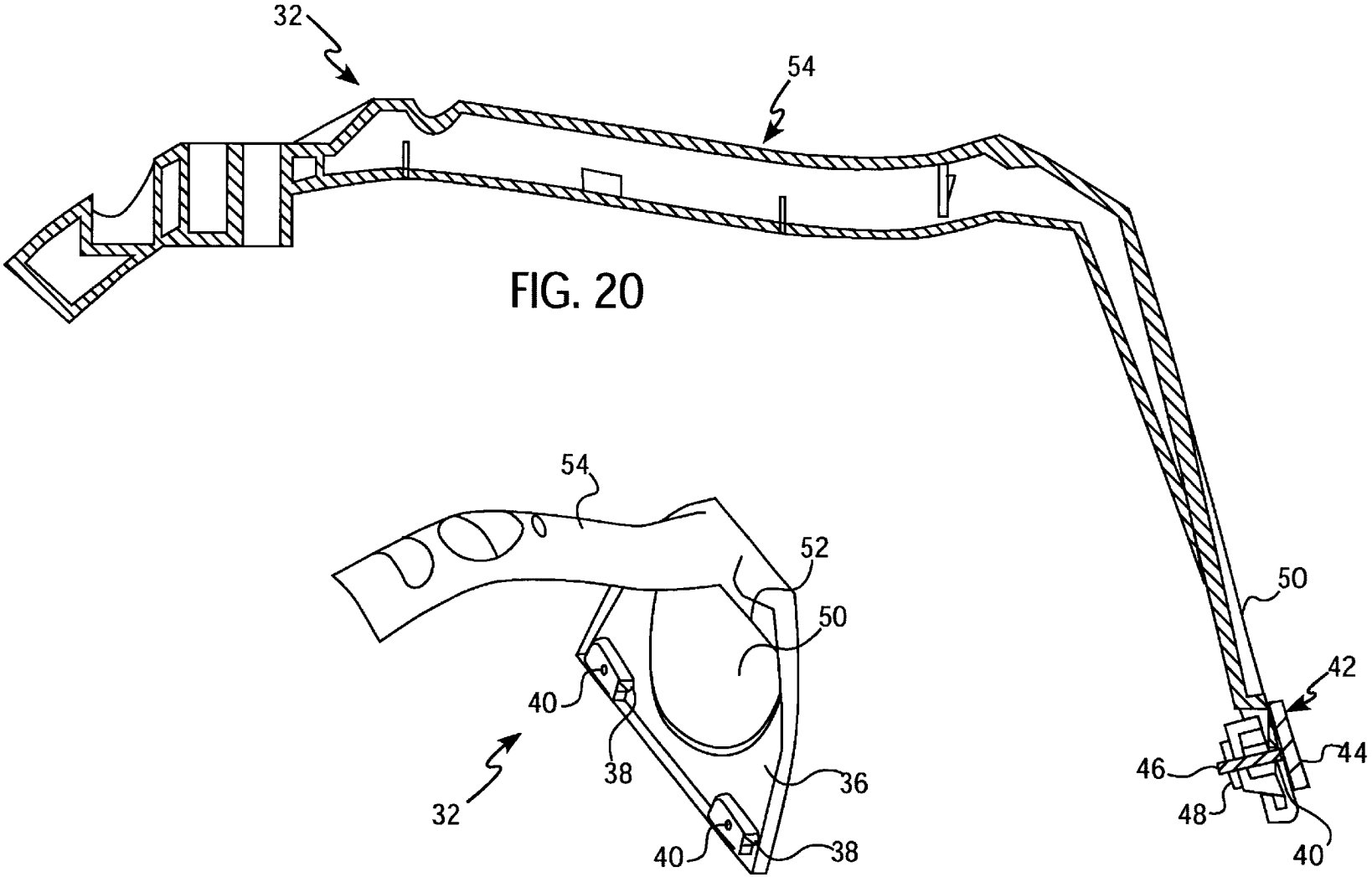
FIG. 17 is a perspective view of an exemplary heel rest of the iron.
FIG. 20 is a longitudinal cross-sectional view of the heel rest, taken along line 20—20 of FIG. 18.
Figure 18:
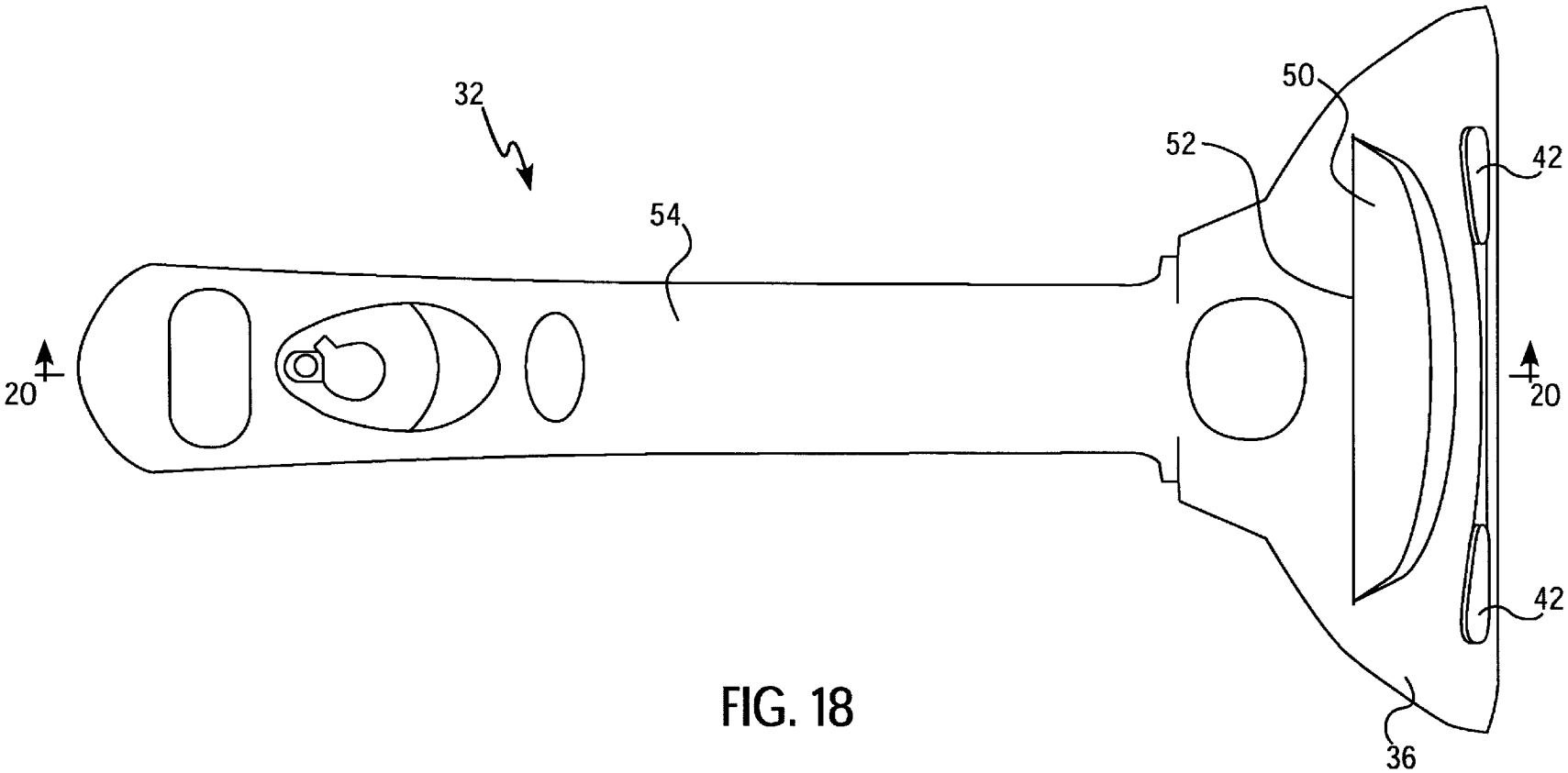
FIG. 18 is a top plan view of the heel rest.
Figure 19:
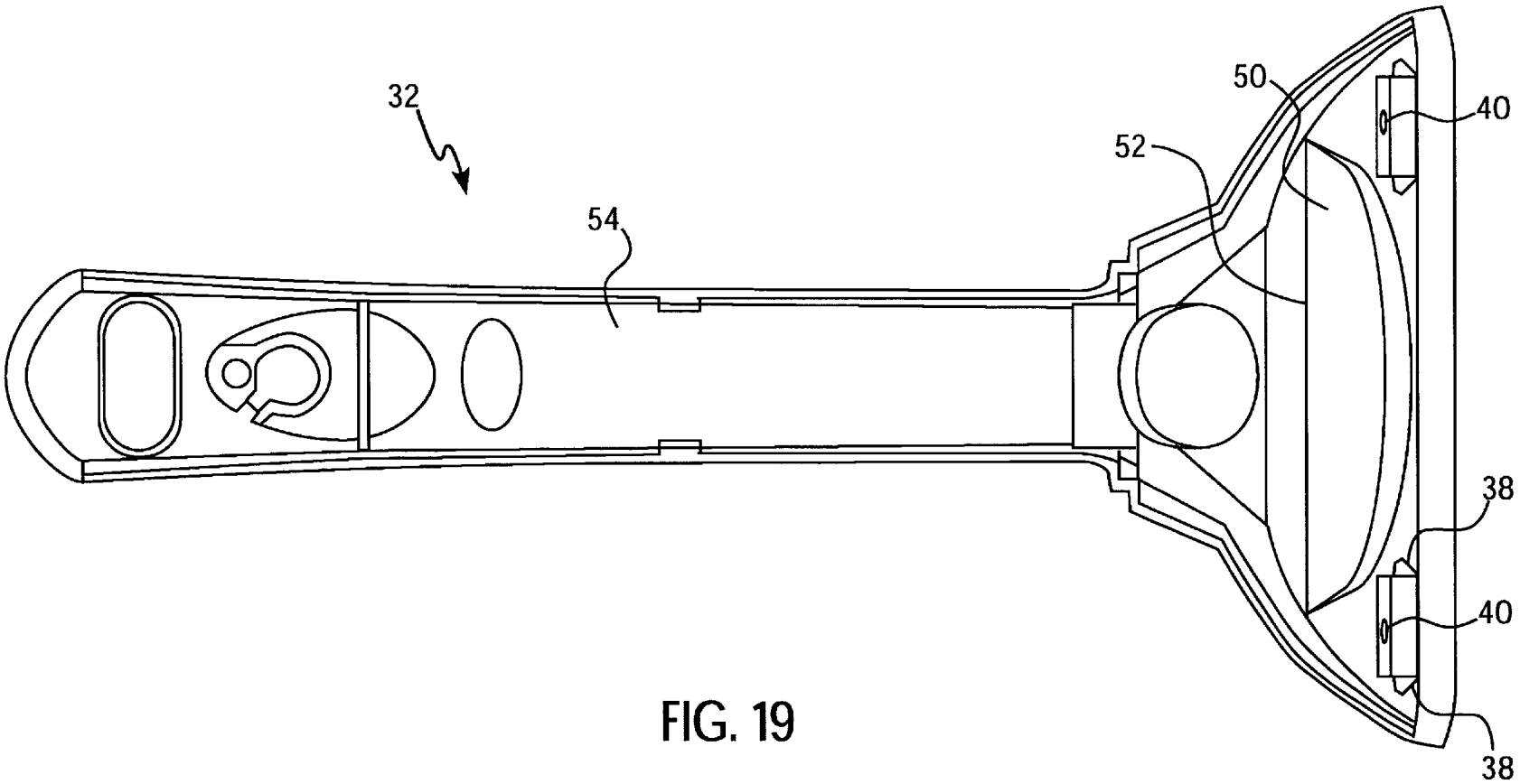
FIG. 19 is a bottom plan view of the heel rest.

In accordance with an exemplary aspect of the present invention, heel rest 32 includes an assembly to prevent iron 10 from tipping over. For example, heel rest 32 may include a rear plate 36 that covers the rear end of iron 10 and which includes lower spring-loaded members 38 that snap into recesses in the rear of water tank 18. Screw holes 40 are provided in rear plate 36 at the positions of, for example, spring-loaded members 38 for holding rubber feet 42 (FIGS. 2–4 and 6) on the outer surface of heel rest 32 adjacent the lower edge thereof. Each rubber foot 42 includes, for example, a rubber pad 44 having a threaded shaft 46 extending inwardly through a screw hole 40 and held thereto by a nut 48 received on threaded shaft 46, as best shown in FIG. 20. Rubber feet 42 are omitted from FIG. 19 for the sake of clarity.

In addition to the above, rear plate 36 includes a central recess 50 having the general shape of, for example, a heel of a shoe, with the linear edge 52 thereof being the top edge of central recess 50, and being coplanar with the remaining outer surface of rear plate 36. In this regard, the depth of recess 50 increases, for example, from upper linear edge 52 to the lower edge thereof. The depth of recess 50 at the lower end preferably ranges from 1.0–3.0 mm, with a preferred depth of approximately 2.5 mm.

According to an exemplary embodiment of the present invention, when iron 10 rests on heel rest 32 in the upright position, the weight of iron 10 forces the soft surface of the ironing board cover downward. Accordingly, the portion of the soft surface of the ironing board cover which lies directly beneath recess 50 is forced to move upward to fill in recess 50. As a result, the soft surface in recess 50 acts as a barrier in recess 50 to prevent iron 10 from tipping over. However, there still may be some slight movement of iron 10 on the soft cover, particularly where upper edge 52 is not recessed, but rather, is coplanar with the outer surface of rear plate 36. In such instance, rubber feet 42 also function to remove any sliding or tipping over of iron 10. Therefore, the combination of recess 50 and rubber feet 42 function to better prevent slipping or tipping over of iron 10 when in its upright position.

In addition, a conventional power cord assembly (not shown) is either fixedly or removably attached to heating element 14 and may also be removably secured to heel rest 32 by a power cord assembly fastening means (not shown) such that the power cord assembly extends outward from heel rest 32.

Heel rest 32 also includes, for example, an elongated top cover 54 that extends forwardly from the upper end of rear plate 36, in order to cover handle 56 of water tank 18. As will be appreciated from the drawings, top cover 54 does not cover fill opening 35. Instead, as discussed above, fill door 34 is provided in covering relation to fill opening 35. However, unlike the prior art which provides, for example, pivotal fill doors which can easily break off and are not stable, fill door 34 according to an exemplary embodiment of the present invention is slidably mounted on handle 56 between a closed position in covering relation to fill opening 35 and a lowered, open position to permit access to fill opening 35.

Figure 9:
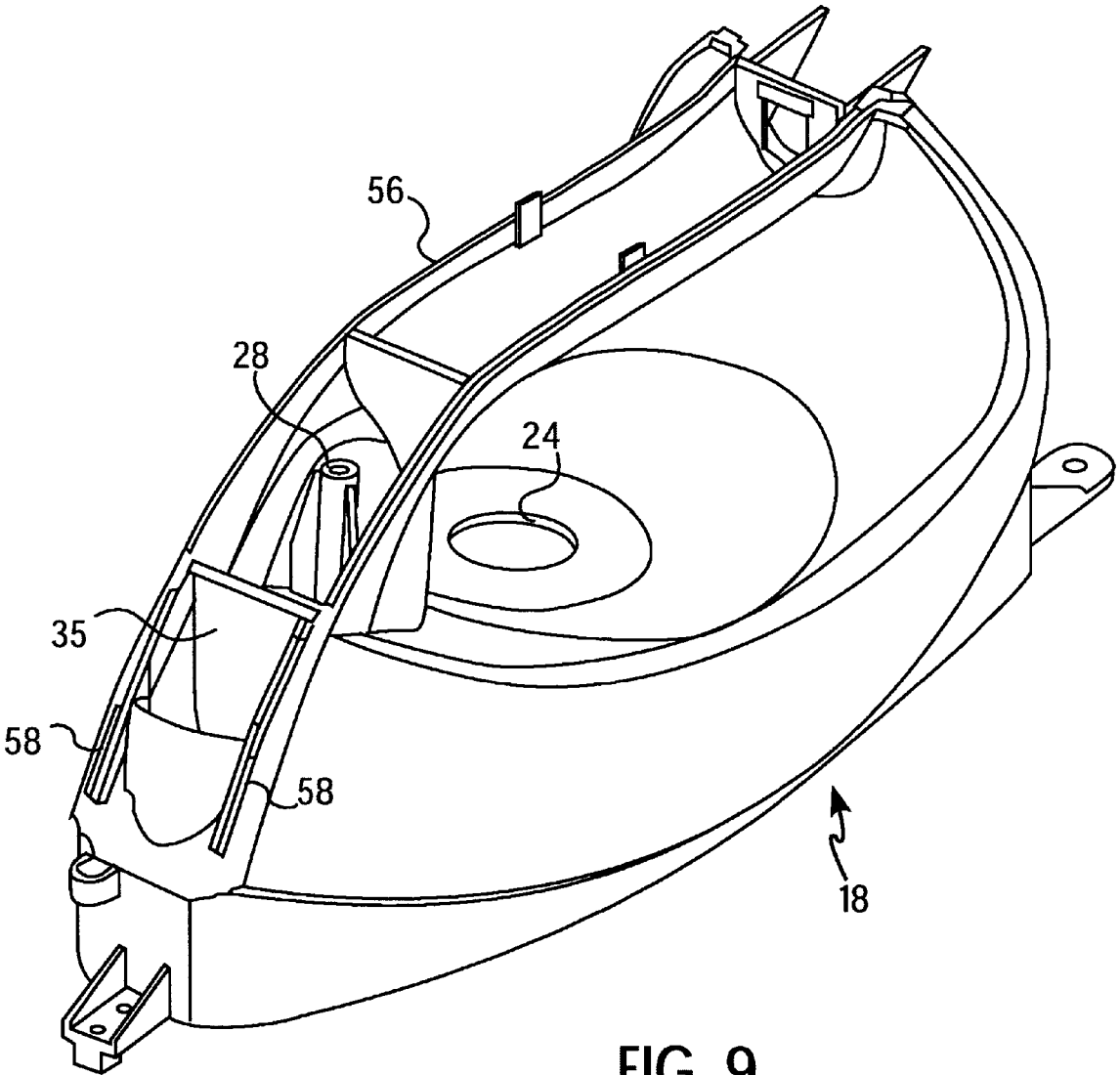
FIG. 9 is a perspective view of an exemplary water tank of the iron.
Figure 10:
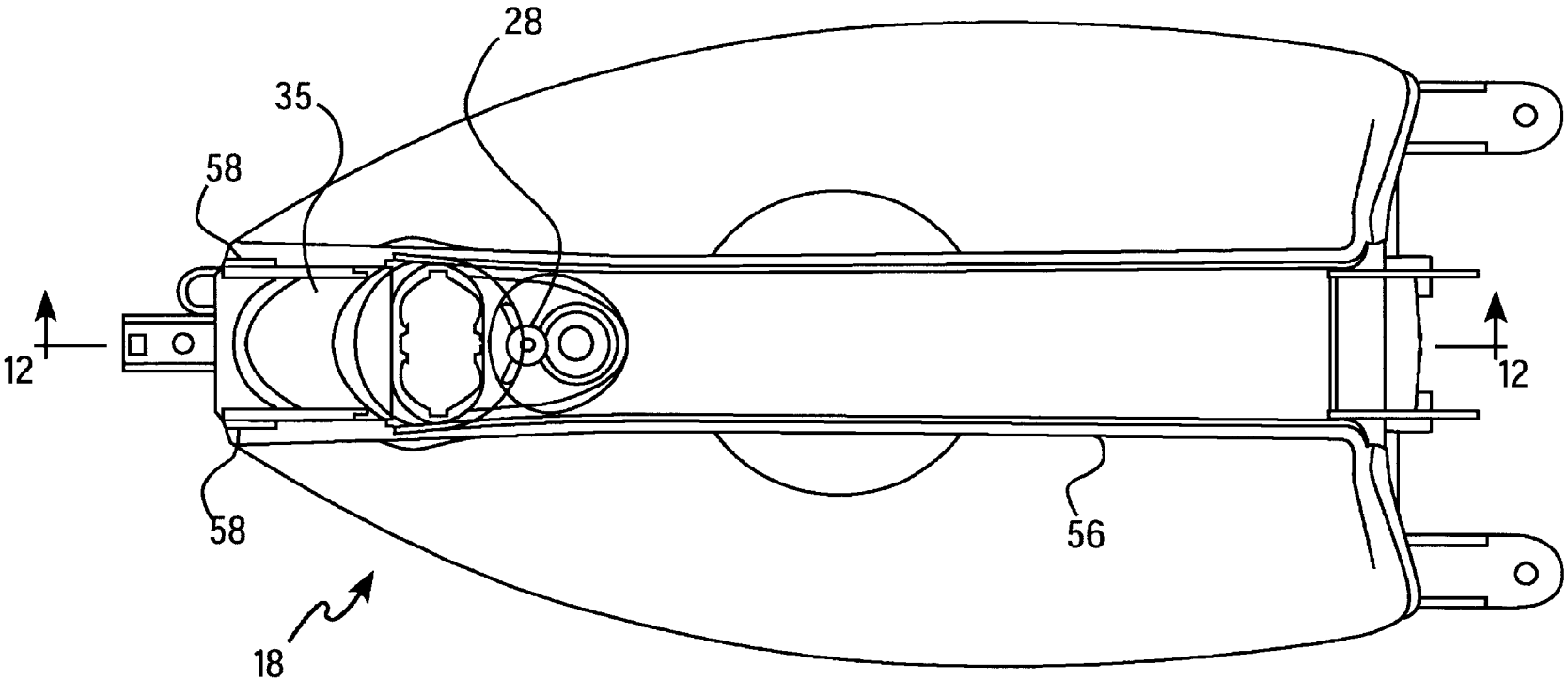
FIG. 10 is a top plan view of the water tank.
Figure 11:
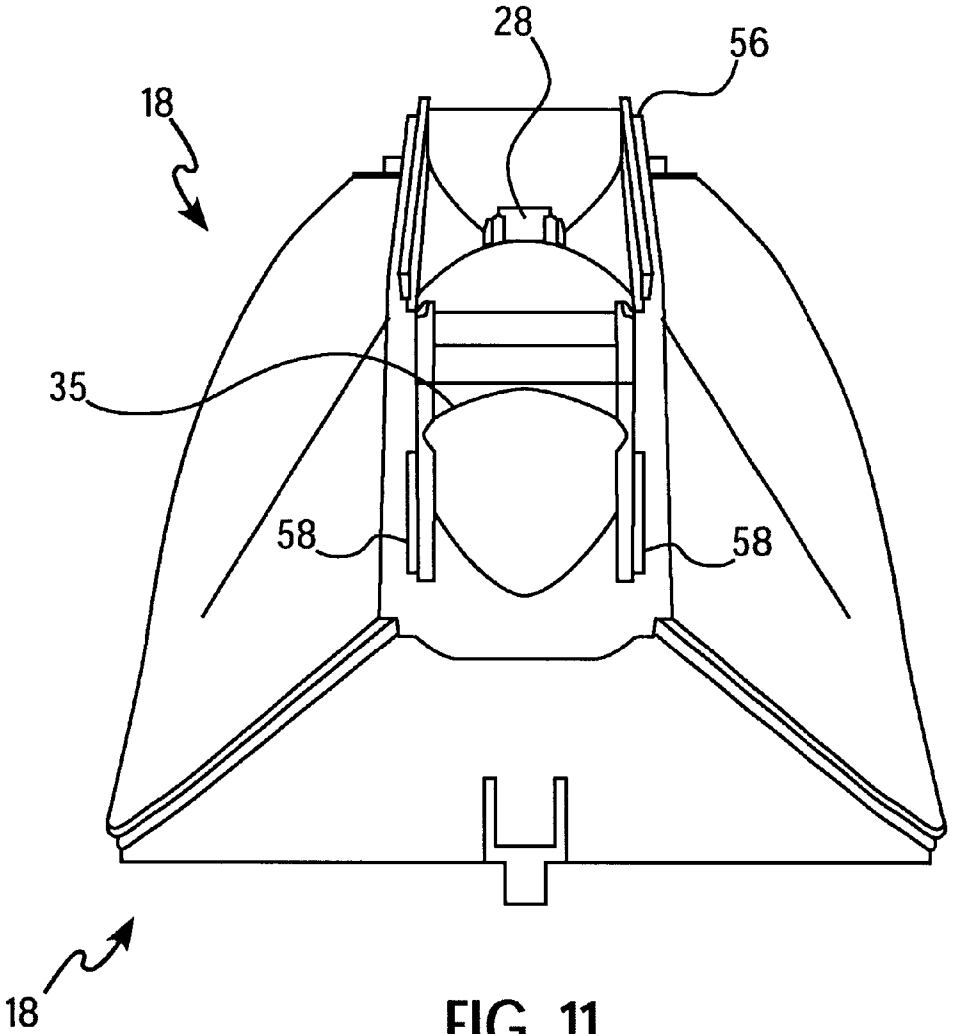
FIG. 11 is a front elevational view of the water tank.
Figure 12:
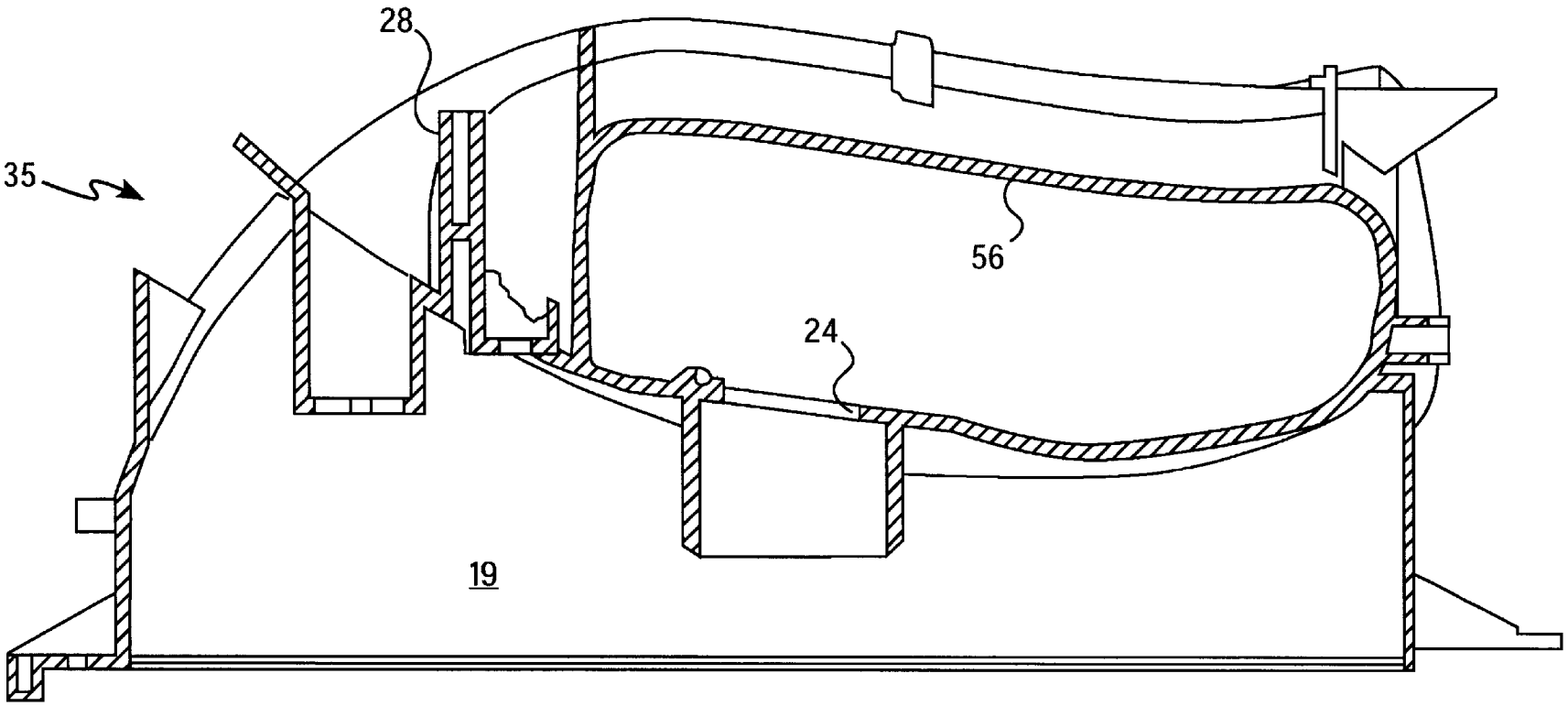
FIG. 12 is a longitudinal cross-sectional view of the water tank, taken along line 12—12 of FIG. 10.

In this regard, as shown in FIGS. 9–11, water tank 34 includes parallel, spaced apart, outwardly extending guide rails 58 on opposite sides of fill opening 35. As shown in FIGS. 21–26, fill door 34 has, for example, a part arcuate or part cylindrical main body 60 with opposite curved, lengthwise extending edges 62 having inner facing grooves 64 therein which ride on guide rails 58. Also, the upper edge of main body 60 is provided with, for example, a finger tab 66 by which a user can slidably move main body 60 between the closed and open positions.

When fill door 34 is slid down along guide rails 58 to the open position, fill door 34 extends into a gap between handle 56 and housing 30 so that it is mostly hidden from view, and more importantly, so that it cannot escape and cannot break off. Slidable movement is limited by finger tab 66 hitting on the upper surface of housing 30 at the front end thereof, that is, finger tab 66 cannot enter housing 30.

Having described exemplary embodiments of the present invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

REFERENCE DESIGNATOR

10 iron
12 soleplate
13 pressing surface
14 heating element
16 skirt
18 water tank
20 cavity
20 water tank cover
22 temperature dial
24 lower opening
26 steam dial
28 upper cylindrical support
30 housing
32 heel rest or rear cover
34 fill door
35 fill opening
36 rear plate
38 lower spring-loaded members
40 screw holes
42 rubber feet
44 rubber pad
46 threaded shaft
48 nut
50 central recess
52 upper linear edge
54 elongated top cover
56 handle
58 guide rails
60 main body
62 edges
64 inner facing grooves
66 finger tab

What is claimed is:

1. An iron comprising:

a soleplate;

a body, said body including a cavity for holding water, said cavity connected to said soleplate for supplying water to said soleplate;

a handle connected to said body; and a rear cover connected to a rear end of said body, said rear cover having a rear plate in covering relation to a rear portion of said iron, and said rear plate including an arrangement for stabilizing said iron in an upright position on a soft surface, said arrangement including:

a recess in an outer surface of said rear plate, wherein said recess slopes down from an edge coplanar with a remainder of said outer surface of said rear plate to an opposite edge having a depth extending inwardly from said remainder of said outer surface of said rear plate.

2. An iron according to claim 1, comprising at least one non-slip foot extending from the outer surface of said rear plate.

3. An iron according to claim 1, wherein said recess has a maximum depth in the range of 1.0 to 3.0 mm.

4. An iron according to claim 2, wherein said at least one non-slip foot is comprised of a rubber material.

5. An iron according to claim 2, wherein said at least one non-slip foot is positioned adjacent a lower edge of said rear plate.

6. An iron according to claim 5, wherein said at least one non-slip foot includes two feet, each positioned adjacent opposite side edges of said rear plate.

7. An iron according to claim 1, wherein said recess has a shape of a shoe heel.

8. An iron comprising:

soleplate;

a body, said body including a cavity for holding water, said cavity connected to said soleplate for supplying water to said soleplate;

a fill opening for filling said cavity with water;

a guide arrangement associated with said fill opening, wherein said guide arrangement includes parallel, spaced apart guide rails;

a handle connected with said body; and a fill door slidably mounted on said guide arrangement between a closed position in covering relation to said fill opening and an open position to permit filling of said cavity with water through said fill opening.

9. An iron according to claim 8, wherein said fill door includes opposite lengthwise edges with grooves for riding along said guide rails.

10. An iron according to claim 8, wherein said fill door has a part cylindrical shape.

11. An iron according to claim 8, further comprising a housing in surrounding relation to said body, with a gap therebetween, and wherein said fill door slides within said housing when in said open position.

12. An iron according to claim 11, wherein said fill door includes a finger tab at an upper edge thereof for moving said fill door between said upper and lower positions, and for limiting sliding movement of said fill door within said housing.

13. An iron comprising:

soleplate;

a body, said body including a cavity for holding water, said cavity connected to said soleplate for supplying water to said soleplate;

a fill opening for filling said cavity with water;

a guide arrangement associated with said fill opening;

a handle connected with said body;

a rear cover connected to a rear end of said body, said rear cover having a rear plate in covering relation to a rear portion of said iron, and said rear plate including an arrangement for stabilizing said iron in an upright position on a soft surface, said arrangement including:

a recess in an outer surface of said rear plate, wherein said recess slopes down from an edge coplanar with a remainder of said outer surface of said rear plate to an opposite edge having a depth extending inwardly from said remainder of said outer surface of said rear plate; and a fill door slidably mounted on said guide arrangement between a closed position in covering relation to said fill opening and an open position to permit filling of said cavity with water through said fill opening.

14. An iron according to claim 13, comprising at least one non-slip foot extending from the outer surface of said rear plate.

15. An iron according to claim 14, wherein said at least one non-slip foot is comprised of a rubber material.

16. An iron according to claim 14, wherein said at least one non-slip foot is positioned adjacent opposite side edges of said rear plate and adjacent a lower edge of said rear plate.

17. An iron according to claim 13, wherein said guide arrangement includes parallel, spaced apart guide rails, and said fill door includes opposite lengthwise edges with grooves for riding along said guide rails.

18. An iron according to claim 13, wherein said fill door has a part cylindrical shape.

19. An iron according to claim 13, further comprising a housing in surrounding relation to said water tank, with a gap therebetween, and said fill door slides within said housing in said open position.

20. An iron according to claim 19, wherein said fill door includes a finger tab at an upper edge thereof for moving said fill door between said upper and lower positions, and for limiting sliding movement of said fill door within said housing.

21. An iron comprising:

a soleplate;

a body, the body including a cavity for holding water, the cavity supplying steam to said soleplate; and a rear cover connected to a rear end of said body, said rear cover having a rear plate in covering relation to a rear portion of said iron, and said rear plate including an arrangement for stabilizing said iron in an upright position on a soft surface, said arrangement including:

at least one foot extending from the outer surface of said rear plate, wherein said foot is comprised of non-slip material.

22. An iron according to claim 21 wherein said at least foot is comprised of a rubber material.

23. An iron according to claim 22, wherein said at least one foot is positioned adjacent a lower edge of said rear plate.

24. An iron according to claim 23, wherein said at least one foot includes two feet, each positioned adjacent opposite side edges of said rear plate.

25. An iron comprising:

a soleplate;

a water tank connected to said soleplate for supplying steam to said soleplate, said water tank including a cavity for holding water;

a handle connected to said water tank; and a rear cover connected to a rear end of said water tank, said rear cover having a rear plate in covering relation to a rear portion of said iron, and said rear plate including an arrangement for stabilizing said iron in an upright position on a soft surface, said arrangement including:

a recess in an outer surface of said rear plate, and at least one non-slip foot extending from the outer surface of said rear plate, wherein said at least one foot is made from a rubber material.

26. An iron comprising:

a soleplate;

a water tank connected to said soleplate for supplying steam to said soleplate, said water tank including:

a cavity for holding water, a fill opening for filling said cavity with water, and a guide arrangement associated with said fill opening;

a handle connected with said water tank;

a rear cover connected to a rear end of said water tank, said rear cover having a rear plate in covering relation to a rear portion of said iron, and said rear plate including an arrangement for stabilizing said iron in an upright position on a soft surface, said arrangement including:

a recess in an outer surface of said rear plate, and at least one non-slip foot extending from the outer surface of said rear plate wherein said at least one foot is made from a rubber material; and a fill door slidably mounted on said guide arrangement between a closed position in covering relation to said fill opening and an open position to permit filling of said cavity with water through said fill opening.

* * * * *